US006166704A

United States Patent [19]

Jan et al.

[11] Patent Number: 6,166,704

[45] Date of Patent: Dec. 26, 2000

[54] DUAL ELLIPTICAL CORRUGATED FEED HORN FOR A RECEIVING ANTENNA

[75] Inventors: Cheng-Geng Jan, Hsinchu; Weili Cheng, Taipei, both of Taiwan

[73] Assignee: Acer NeWeb Corp., Taiwan

[21] Appl. No.: 09/288,311

[22] Filed: Apr. 8, 1999

[51] Int. Cl.[7] ..... H01Q 13/02

[52] U.S. Cl. ..... 343/840; 343/786

[58] Field of Search ..... 343/840, 772, 343/773, 775, 776, 872

[56] References Cited

U.S. PATENT DOCUMENTS 4,740,795 4/1988 Seavey ..... 343/786
5,438,340 8/1995 Fukuzawa et al. ..... 343/781 R
5,625,365 4/1997 Tom et al. ..... 343/700 MS
5,812,096 9/1998 Tilford ..... 343/781 R

*Primary Examiner*—Don Wong
*Assistant Examiner*—James Clinger
*Attorney, Agent, or Firm*—Michael D. Bednarek.; Shaw Pittman

[57] ABSTRACT

This invention is a compact and cost effective signal receiver for use in conjunction with a parabolic reflector to receive electromagnetic signals from two satellites. The signal receiver has a dual elliptical corrugated feed horn to increase C/N ratio and reduce the spill over loss of the energy of signals receiving from two satellites, and to provide a sufficient rejection for preventing interference coming from the other satellite.

8 Claims, 8 Drawing Sheets

DUAL ELLIPTICAL CORRUGATED FEED HORN FOR A RECEIVING ANTENNA

BACKGROUND OF THE INVENTION

1. Field of the Invention

This invention relates generally to electromagnetic signal receiving devices, and more particularly to an electromagnetic signal receiving device having a dual elliptical corrugated feed horn.

2. Description of the Prior Art

Direct Broadcast Satellite (DBS) is a point-to-multipoint system in which individual households equipped with a small receiving antenna and tuner device receive broadcasts directly from a geostationary satellite. The satellite receives digital audio and video transmissions from ground stations and relays them directly to individuals. The receiving antenna is comprised of a parabolic reflector designed to collect the satellite signals and focus them at the focal point, where a Low Noise Block with integrated Feed (LNBF) module is mounted to convert the incoming signals to a lower frequency band and transmit it to a tuner device. Microwave signals aligned to the axis of the parabolic reflector are collected at the focal point, where the LNBF module is located. The LNBF module also acts as a filter and an amplifier to selectively boost the signal received by the dish collector. The LNBF module comprises a feed for receiving microwave signals and circuitry for processing the received microwaves.

Because of the high sensitivity of these devices and relatively high satellite transmitting power, the parabolic reflector currently being used can be as small as 0.4 meter in diameter. The dishes are mounted outside the home and are manually aligned with the help of a diagnostic display showing received signal strength. Inside the home, a phase-lock loop tuner demodulates the signal from the LNBF module into video and audio signals suitable for a television or stereo tuner.

Normally, each satellite dish antenna is aligned to receive signals from a particular cluster (or group) of satellites in a certain direction. To a dish antenna on earth, the satellites belonging to the same cluster are located so close together that their signals are often indistinguishable from signals radiating from a single satellite. To overcome this problem, when receiving signals from different satellite clusters, more than one dish antenna may be used to point to the different satellites. Another method is to use an electric motor to turn the antenna assembly to point to different satellites. However, employing these methods would make the antenna too complicated and expensive for general home use.

When two satellites (or two clusters of satellites) are separated by a small angle (the angle being larger than the separation angle between satellites within the same cluster), it is possible to use dual LNBF modules placed side by side near the focal point to receive signals from the two satellites. The prior art includes Sharp Corporation's implementation of dual circular corrugated feed horn technology for receiving signals from two satellites shown in FIG. 1. Since the parabolic reflector only has one focus point, the dual circular feed horn needs to be configured to offset the deviation because each of the dual circular feed horn is not in focus. Such a configuration will result in a wider radiation pattern beamwidth, both in the horizontal and vertical directions, than the case of separately aiming at the two satellites by placing the feeds at the focal point of the dish antenna. The wider radiation pattern beamwidth in the horizontal direction can be offset by adjusting the separation of the dual circular feed horn. However, the wider radiation pattern beamwidth in the vertical direction causes an increase in the spill-over loss in the vertical direction. The spill-over loss will show up as a decrease in carrier intensity (of the signal received from the satellite) to noise (C/N) ratio, which will affect signal reception quality. Further, a wider radiation pattern will cause an insufficient rejection for preventing interference coming from the other satellite.

The radiation field pattern of a feed horn is correlated with the width of the horn aperture. The wider the horn aperture is, the narrower the radiation field pattern will become. Though spill-over will be reduced by using a wider horn aperture to narrow down the radiation field pattern of the dual circular feed horn in the vertical direction, this simultaneously narrows down the radiation field pattern of the feed in the horizontal direction. A narrower radiation field pattern of the feed will result in a wider radiation field pattern reflected from the reflector and toward the satellite. This wider radiation field pattern will cause serious interference of the signals from two distinct satellites in the horizontal direction when a wider horn aperture is employed for the dual circular feed horn.

SUMMARY OF THE INVENTION

What is needed, therefore, is a compact and efficient signal receiving apparatus that can discriminate the signals and reduce signal interference from a plurality of different sources.

The present invention provides a signal receiving apparatus for receiving electromagnetic signals transmitted from two distinct sources. The signal receiving apparatus comprises a parabolic reflector for reflecting and collecting the electromagnetic signals from the two sources, and a dual signal feed horn operably disposed at the focal point of the parabolic reflector for receiving the electromagnetic signals collected by the parabolic reflector. The dual signal feed horn includes a pair of frustums. The cross-section of the frustums linearly devolves from a substantially circular connecting end to a predetermined substantially elliptical end. The dual signal feed horn further includes a figure-eight-shaped dual elliptical horn aperture having a corrugated inner surface. The figure-eight-shaped dual elliptical horn aperture is coupled to the predetermined substantially elliptical end of the frustums.

The signal receiving apparatus further comprises two cylindrical waveguides. Each of the cylindrical waveguides is coupled to the substantially circular connecting end of each of the frustums. The radius of the cylindrical waveguides is substantially the same as the radius of the substantially circular connecting end.

One advantage of the present invention is to provide a compact and cost effective signal receiver for use in conjunction with a parabolic reflector to receive signals from two satellites.

Another advantage of the present invention is to provide a compact signal receiver having a dual elliptical corrugated feed horn to increase C/N ratio and reduce the spill-over loss of the energy of signals received from two satellites.

Still another advantage of the present invention is to provide a compact signal receiver having a dual elliptical corrugated feed horn to provide sufficient rejection for preventing interference from the other satellite.

Other features, advantages and embodiments of the invention will be apparent to those skilled in the art from the following description, accompanying drawings and appended claims.

BRIEF DESCRIPTION OF THE DRAWINGS

FIG. 3(*b*) shows a sectional view of a dual signal feed horn in accordance with an embodiment of the present invention.

DESCRIPTION OF THE INVENTION

The present invention provides a signal receiver for receiving signals emanating from two satellites. The signal receiver comprises a dual elliptical corrugated feed horn for increasing C/N ratio and reducing the spill over loss of the energy of signals received from two satellites. For clarity of description, an LNBF (Low Noise Block with integrated Feed) is used as an exemplary illustration of an embodiment and should not limit the scope of the present invention.

In the following descriptions, for clarity and when convenient, similar components will have the same numbering labels.

The present invention provides a signal receiving apparatus for receiving electromagnetic signals transmitted from two distinct sources. The signal receiving apparatus comprises a parabolic reflector for reflecting and collecting the electromagnetic signals from the two sources, and a dual signal feed horn operably disposed at the focal point of the parabolic reflector for receiving the electromagnetic signals collected by the parabolic reflector. The dual signal feed horn includes a pair of frustums. The cross-section of the frustums linearly devolves from a substantially circular connecting end to a predetermined substantially elliptical end. The dual signal feed horn further includes a figure-eight-shaped dual elliptical horn aperture having a corrugated inner surface. The figure-eight-shaped dual elliptical horn aperture is coupled to the predetermined substantially elliptical end of the frustums. The signal receiving apparatus further comprises two cylindrical waveguides. Each of the cylindrical waveguides is coupled to the substantially circular connecting end of each of the frustums. The radius of the cylindrical waveguides is substantially the same as the radius of the substantially circular connecting end.

Figure 1:
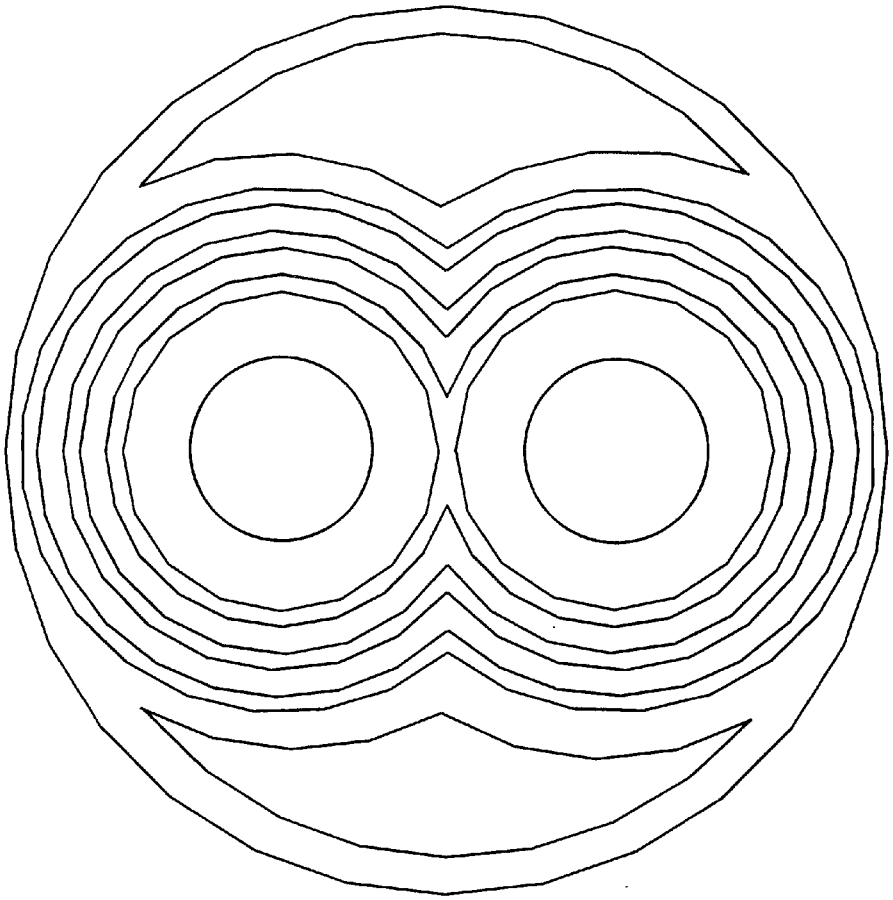
FIG. 1 (PRIOR ART)
FIG. 1 is a front view of a prior art dual circular corrugated feed horn.
Figure 2:
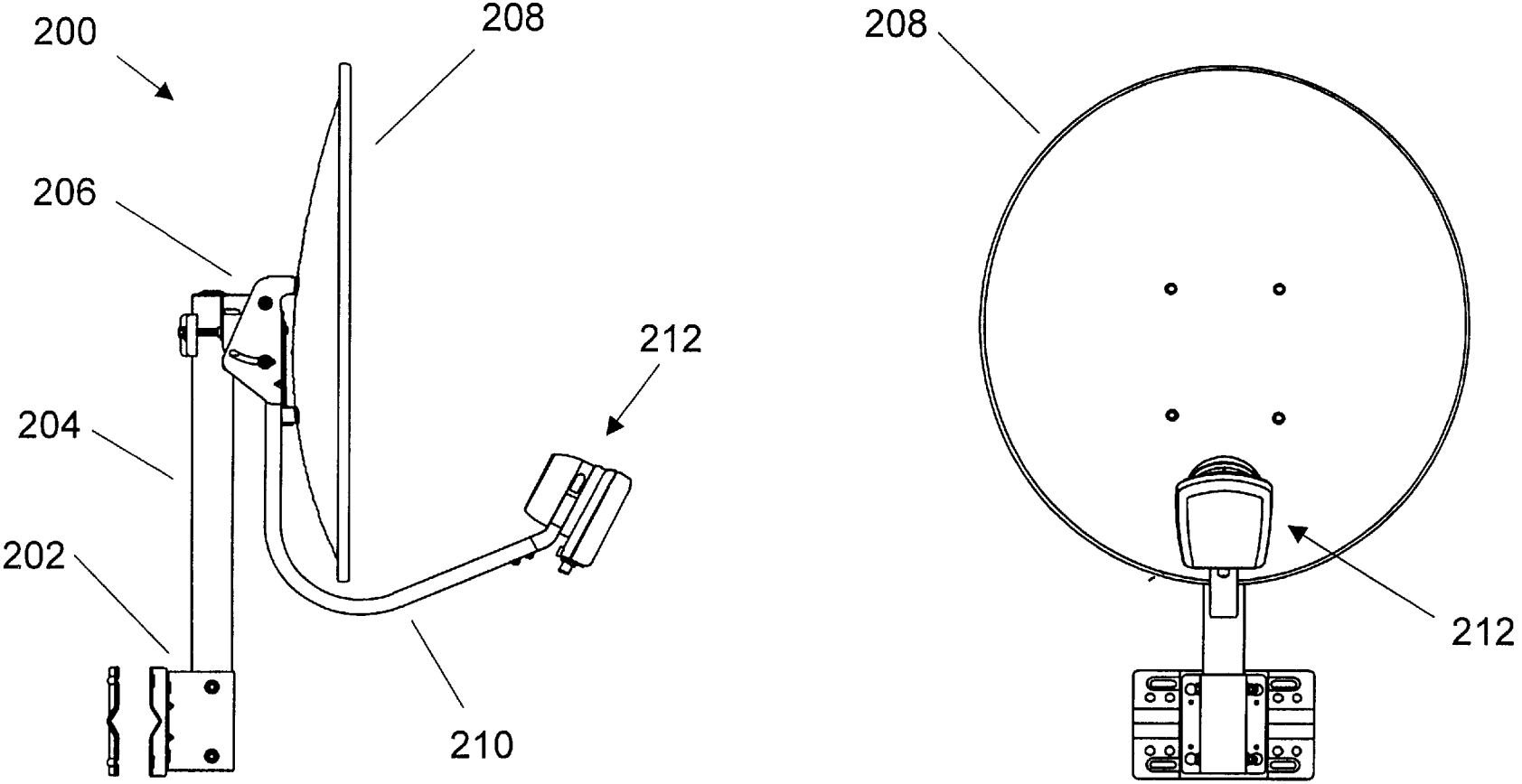
FIG. 2 shows a satellite signal receiving system in accordance with the present invention.

FIG. 2 shows a satellite signal receiving system embodying the present invention. A receiving system 200 comprises a base mount 202, a mast 204, a dish bracket 206, a parabolic reflector 208, an extending arm 210, and an dual LNBF module 212. The base mount 202 provides support for the receiving system 200. The mast 204 is coupled to the base mount 202 and the dish bracket 206. The dish bracket 206 is in turn coupled to the parabolic reflector 208 and to one end of the extending arm 210. The other end of the extending arm 210 is coupled to the dual LNBF module 212. By adjusting the positions of the parabolic reflector 208 and the dual LNBF module 212, the parabolic reflector 208 can be directed towards two satellites, and have the signals collected towards the dual LNBF module 212.

Figure 3A:
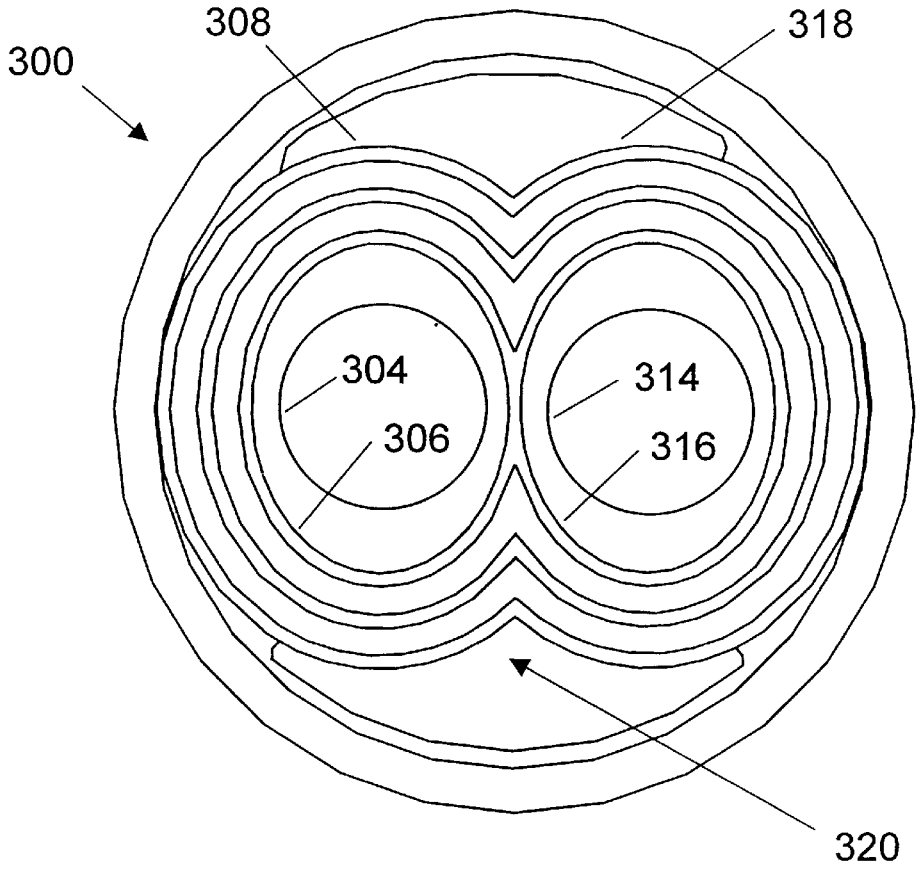
FIG. 3(*a*) shows a front view of a dual signal feed horn in accordance with an embodiment of the present invention.
Figure 3B:
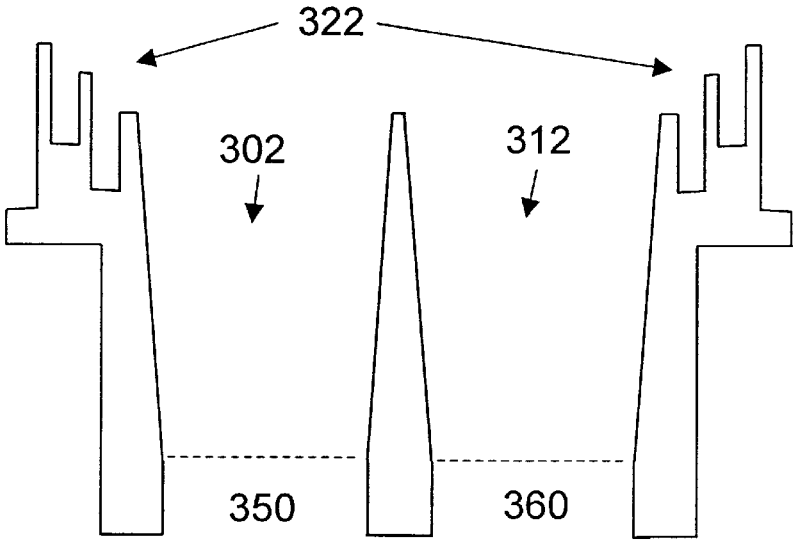

FIGS. 3(*a*) and 3(*b*) show an embodiment of a front view and sectional view of a dual signal feed horn in accordance with the present invention. The dual signal feed horn 300 of the dual LNBF module 212 operably is disposed substantially at the focal point of the parabolic reflector 208 for receiving the electromagnetic signals collected by the parabolic reflector 208. The dual signal feed horn 300 includes a pair of frustums 302 and 312. The cross-section of the frustum 302 (312) linearly devolves from a substantially circular connecting end 304 (314) to a predetermined substantially elliptical end 306 (316). In other words, the length of the long axis and the short axis of the cross-section of the frustum 302 (312) linearly increase at a respectively constant rate thereby forming the predetermined substantially elliptical end 306 (316).

The dual signal feed horn 300 further includes a figure-eight-shaped dual elliptical horn aperture 320 having a corrugated inner surface 322. The figure-eight-shaped dual elliptical horn aperture 320 is coupled to the predetermined substantially elliptical ends 306 and 316. The figure-eight-shaped dual elliptical horn aperture 320 comprises a pair of quasi-elliptical horn elements 308 and 318. The figure-eight-shaped dual elliptical horn aperture 320 is shaped like a cutting of the overlapping portion of two elliptical horn elements and merging the remains of these two elliptical horn elements (which are "quasi-elliptical" horn elements 308 and 318). The long axis to short axis ratio is fixed for the cross-section of both the quasi-elliptical horn elements 308 and 318, which is substantially the same as that of the predetermined substantially elliptical ends 306 and 316.

Since it requires a wider radiation pattern beamwidth both in the horizontal and the vertical direction for the dual signal feed horn to offset the position which is out of focus, the wider radiation pattern beamwidth in the horizontal direction can be offset by adjusting the separation of the frustums 302 and 312. More importantly, the wider radiation pattern beamwidth in the vertical direction will be significantly reduced by using the dual signal feed horn in accordance with the present invention. This is because the combination of the figure-eight-shaped dual elliptical horn aperture 320 and the devolving elliptical frustums 302 and 312 has a narrower beamwidth in the vertical direction than a conventional dual circular feed horn. In other words, the combination will provide a narrower radiation pattern in the vertical direction for filtering out unwanted signals and reducing spill-over loss. Accordingly, it effectively increases C/N ratio and provides a sufficient rejection for preventing interference from the other satellite.

The LNBF module 212 further comprises two cylindrical waveguides 350 and 360. The cylindrical waveguide 350 (360) is coupled to the substantially circular connecting end 304 (314) of the frustum 302 (312). The radius of the cylindrical waveguide 350 (360) is substantially the same as the radius of the substantially circular connecting end 304 (314).

Figure 4A:
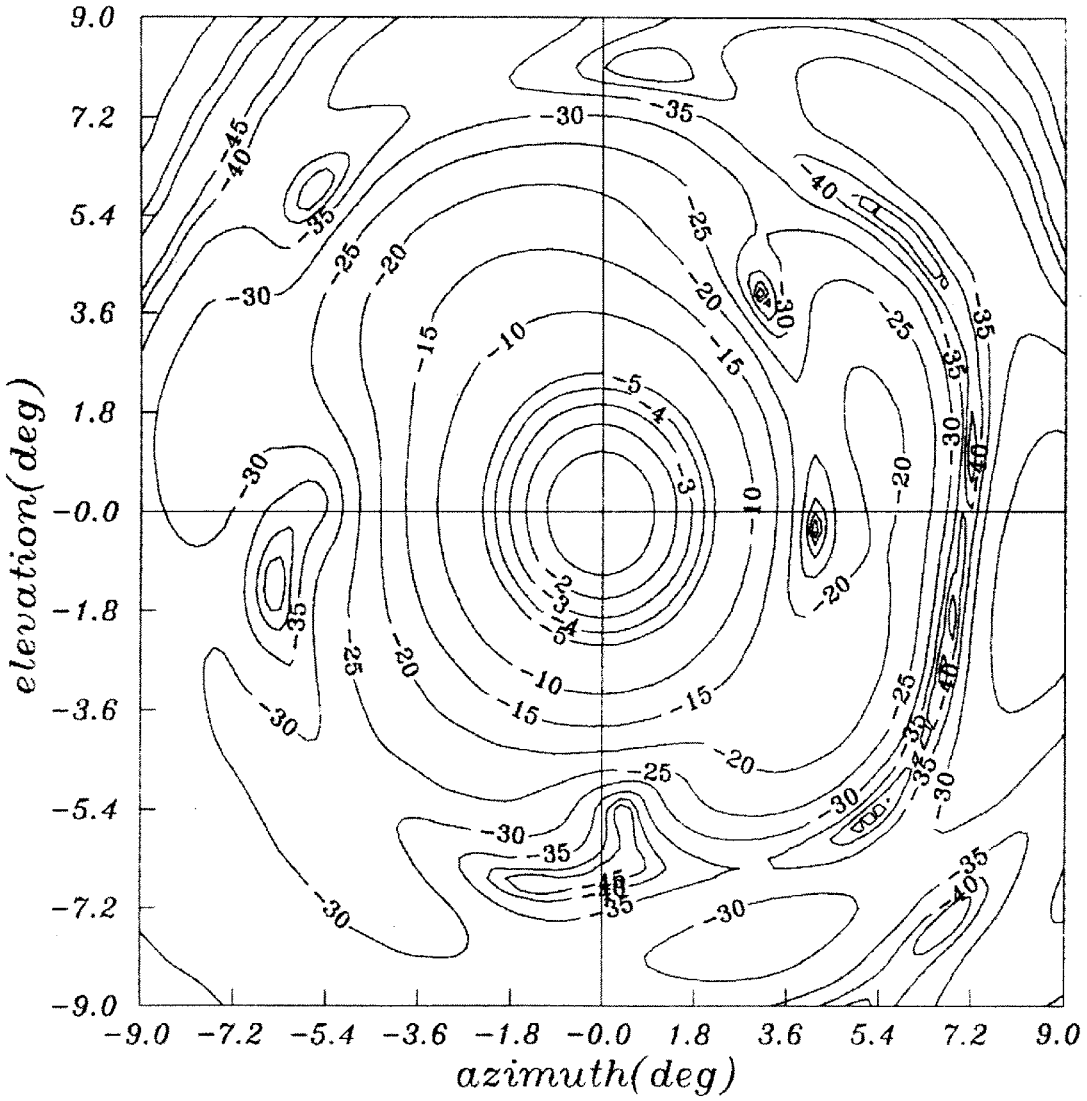
FIGS. 4(*a*)–(*b*) show the far-field radiation contour patterns with horizontal and vertical polarization respectively for a dual elliptical corrugated feed horn utilizing the present invention aimed at a satellite at longitude 124° east.
Figure 4B:
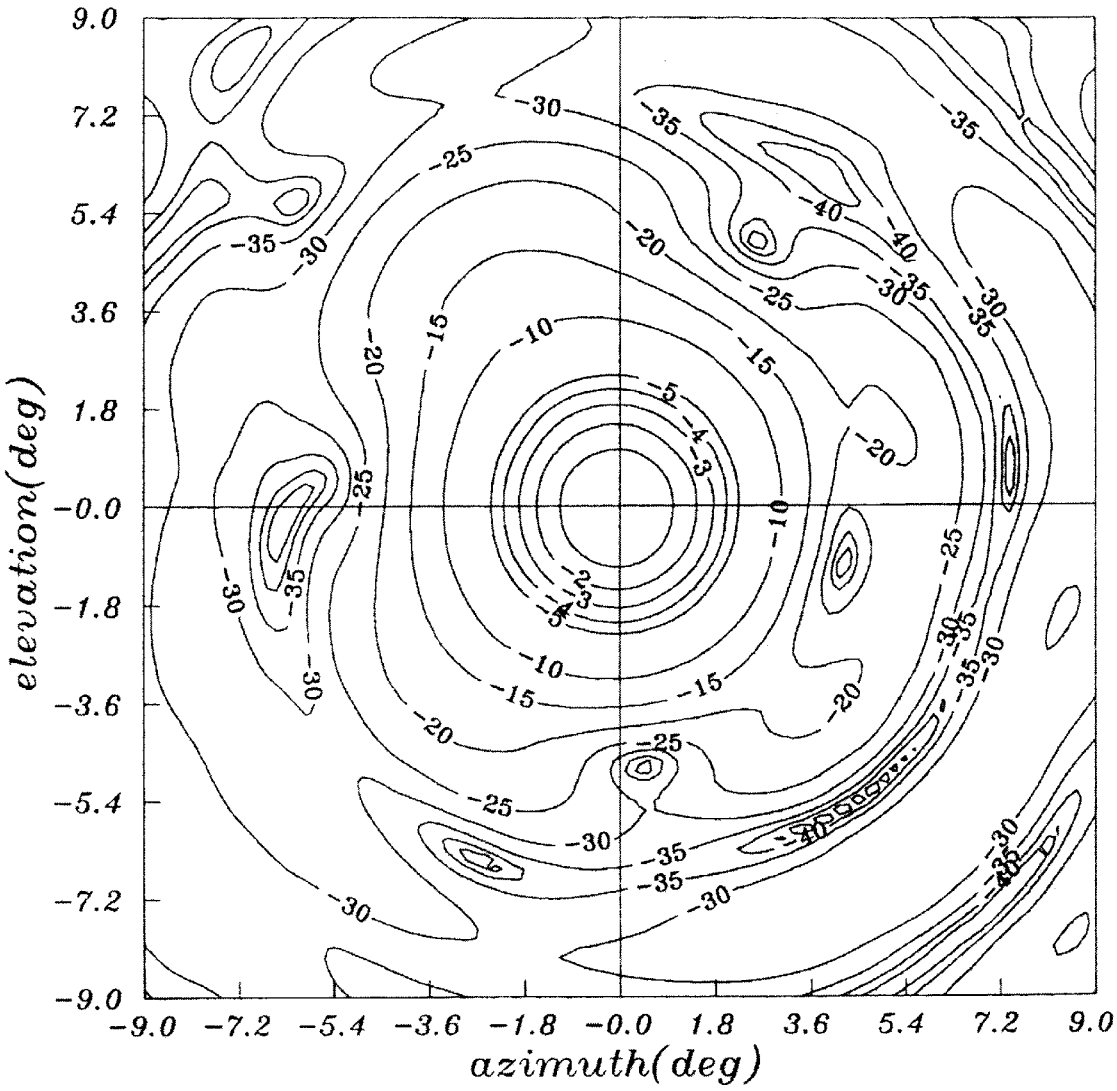
Figure 5A:
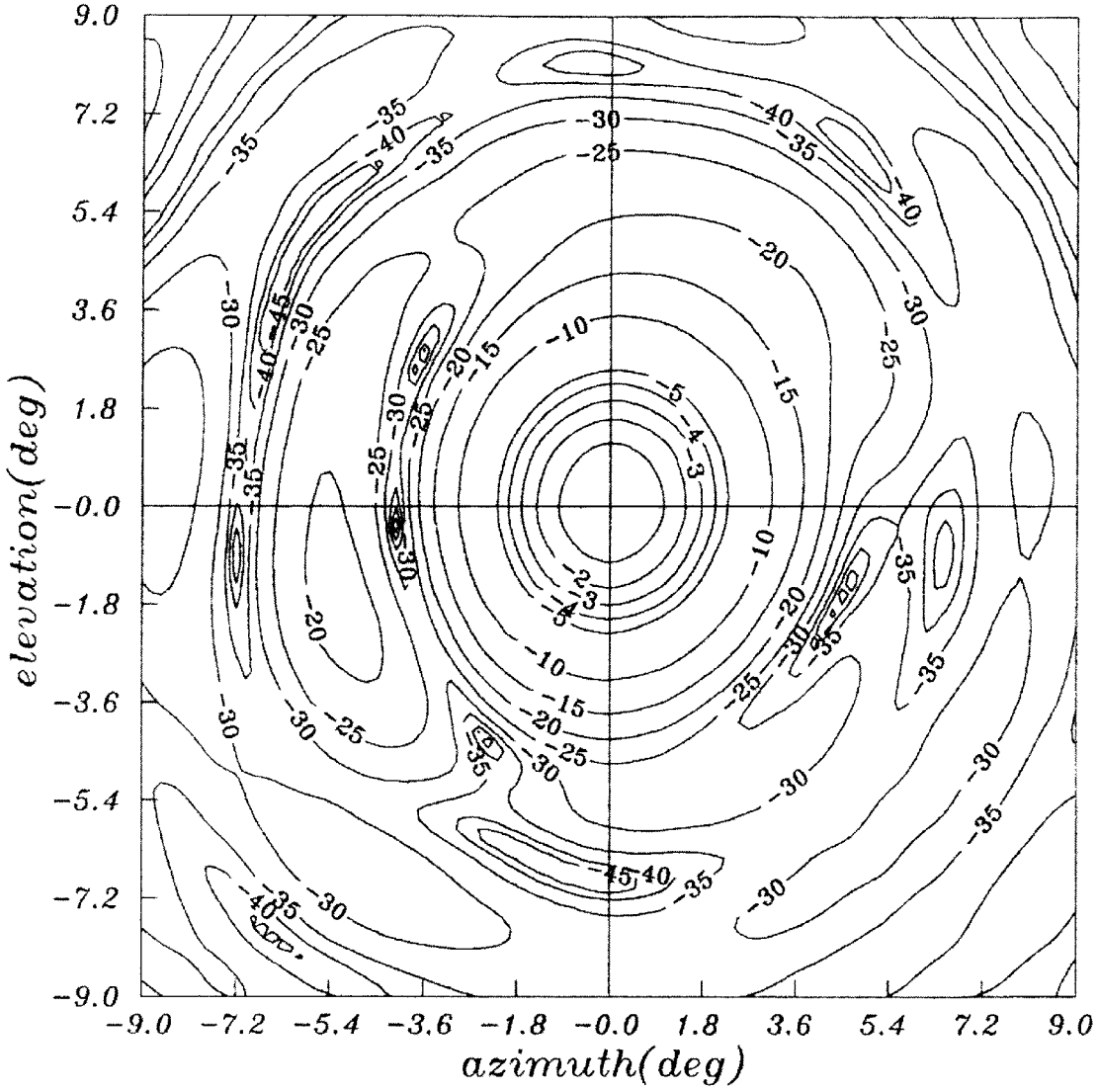
FIGS. 5(*a*)–5(*b*) show the far-field radiation contour patterns with horizontal and vertical polarization respectively for a dual elliptical corrugated feed horn utilizing the present invention aimed at a satellite at longitude 128° east.
Figure 5B:
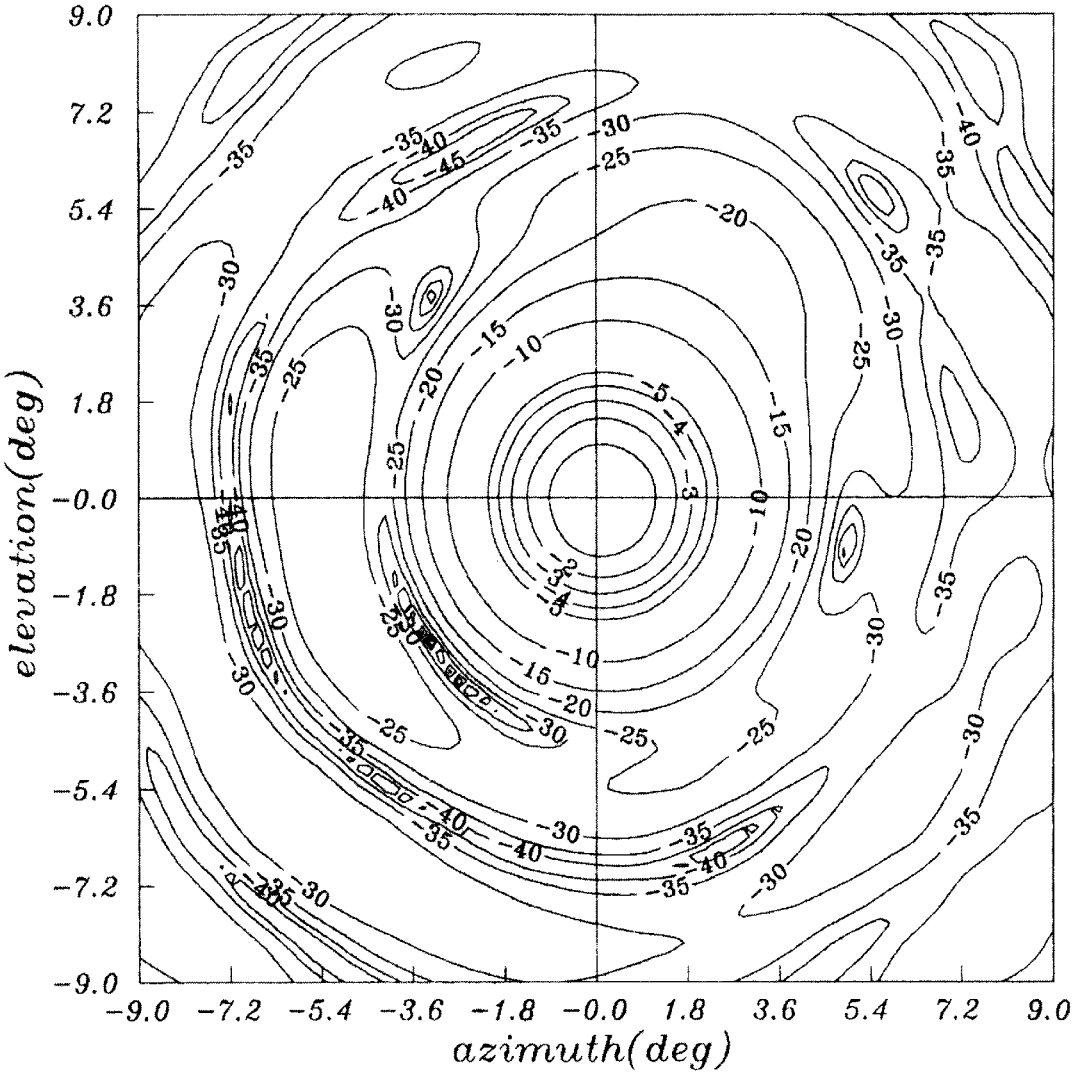

In one embodiment of the present invention, the frustums 302 and 312 of the dual signal feed horn 300 aim at the satellites at longitude 124° east and 128° east respectively for receiving electromagnetic signals transmitted from these two satellites. For a parabolic reflector with an f/D (parabolic dish focal length over parabolic dish diameter) ratio of 0.46, the predetermined substantially elliptical end 306 (316) has a long axis to short axis ratio of substantially 1.2. The cross-section of the frustum 302 (312) linearly devolves from a substantially circular connecting end 304 (314) to a predetermined substantially elliptical end 306 (316). The ratio also can be adjusted suitably for another pair of satellites in appropriate with the position and the separation of the satellites. The long axis to short axis ratio is fixed for the cross-section of both the quasi-elliptical horn elements 308 and 318, which is substantially the same as that of the predetermined substantially elliptical ends 306 and 316. FIGS. 4(*a*)–(*b*) and 5(*a*)–(*b*) show the far-field radiation contour patterns with horizontal (FIGS. 4(*a*) and 5(*a*)) and vertical (FIGS. 4(*b*) and 5(*b*)) polarization for the satellites at longitude 124° east and 128° east in accordance with the present invention. The X-axis and Y-axis in FIGS. 4(*a*)–(*b*) and 5(*a*)–(*b*) are azimuth angle and elevation angle respectively. It shows that the gain drop at ±4.5 degrees of azimuth reaches at least −20 dB for both vertical and horizontal polarization to provide a sufficient rejection for preventing interference coming from the other satellite.

TABLE 1 is a comparison of C/N ratio of Sharp Corporation's antenna with a dual circular feed and the antenna with a dual elliptical corrugated feed horn utilizing the present invention aiming at the satellites at longitude 124° east and 128° east. It is measured by using AIWA CS Digital Tuner (Model No.: SU-CS1).

The meanings of the columns are the transmitting frequency from these satellites $f_1$ (GHz), the LNBF output frequency $f_2$ (MHz), the direction of polarization, and the C/N ratio for satellites JCSAT4 at longitude 124° east and JCSAT3 at longitude 128° east in sequence, wherein the upper C/N ratio and the lower C/N ratio correspond to Sharp's antenna (labeled by S) and the antenna with a dual elliptical corrugated feed horn utilizing the present invention (labeled by A) respectively. According to TABLE 1, it is apparent that the antenna with a dual elliptical corrugated feed horn provides better performance and a higher C/N ratio than that of a conventional dual circular feed horn.

While the above is a full description of the specific embodiments, various modifications, alternative constructions and equivalents may be used. For example, the long axis to short axis ratio of the elliptical end for another pair of satellites, and the number of the corrugation can be changed according to practical considerations.

Therefore, the above description and illustrations should not be taken as limiting the scope of the present invention which is defined by the following claims.

What is claimed is:

1. A signal receiving apparatus for receiving electromagnetic signals transmitted from two distinct sources, comprising:

a parabolic reflector for reflecting and collecting the electromagnetic signals from said two sources; and a dual signal feed horn operably disposed substantially at the focal point of said parabolic reflector, for receiving the electromagnetic signals collected by said parabolic reflector, said dual signal feed horn including a pair of frustums, the cross-section of said frustums linearly devolving from a substantially circular connecting end to a predetermined substantially elliptical end, and a figure-eight-shaped dual elliptical horn aperture having a tapered corrugated inner surface, coupled to said predetermined substantially elliptical end of said frustums.

2. The signal receiving apparatus of claim 1, wherein said two distinct sources are separated by substantially four longitudinal degrees.

3. The signal receiving apparatus of claim 2, wherein said two distinct sources are a satellite at longitude 124° east and a satellite at longitude 128° east respectively.

4. The signal receiving apparatus of claim 3, wherein said predetermined substantially elliptical end has a long axis to short axis ratio of substantially 1.2.

5. The signal receiving apparatus of claim 1 further comprising:

TABLE 1

| | | | | | | | | | | | | | |
|---|---|---|---|---|---|---|---|---|---|---|---|---|---|
| $f_1$(GHz) | | 12.268 | 12.288 | 12.348 | 12.368 | 12.388 | 12.408 | 12.428 | 12.448 | 12.508 | 12.523 | 12.538 | 12.558 |
| $f_2$(MHz) | | 1068 | 1088 | 1148 | 1168 | 1188 | 1208 | 1228 | 1248 | 1308 | 1323 | 1338 | 1358 |
| Polarization | | V | H | V | H | V | H | V | H | V | H | V | H |
| JCSAT4 | S | — | — | — | — | — | — | — | — | 15 | 15 | 15/14 | 14 |
| (124° E.) | A | — | — | — | — | — | — | — | — | 16 | 16 | 16/15 | 16 |
| JCSAT3 | S | 16 | 18 | 16 | 16/15 | 16/15 | 18/17 | 16 | — | 16 | 16 | 15/14 | 17 |
| (128° E.) | A | 17 | 20/19 | 17 | 16 | 17 | 19/18 | 17 | — | 17 | 17 | 16 | 19/18 |
| $f_1$(GHz) | | 12.568 | 12.583 | 12.598 | 12.613 | 12.628 | 12.643 | 12.658 | 12.673 | 12.688 | 12.703 | 12.718 | 12.733 |
| $f_2$(MHz) | | 1368 | 1383 | 1398 | 1413 | 1428 | 1443 | 1458 | 1473 | 1488 | 1503 | 1518 | 1533 |
| Polarization | | V | H | V | H | V | H | V | H | V | H | V | H |
| JCSAT4 | S | 14 | 16/15 | 15 | — | 14 | 16 | 13 | 15 | 14 | 15 | 15/14 | 16 |
| (124° E.) | A | 15 | 17/16 | 17/16 | — | 15 | 17 | 15/14 | 17 | 16/15 | 17 | 16 | 18 |
| JCSAT3 | S | 13 | 17 | 14 | 16 | 14 | 15/14 | 15/14 | 16 | 13 | 17 | 14 | — |
| (128° E.) | A | 14 | 18 | 15 | 18 | 15 | 16 | 16 | 18 | 15 | 19/18 | 16 | — |

Figure 6:
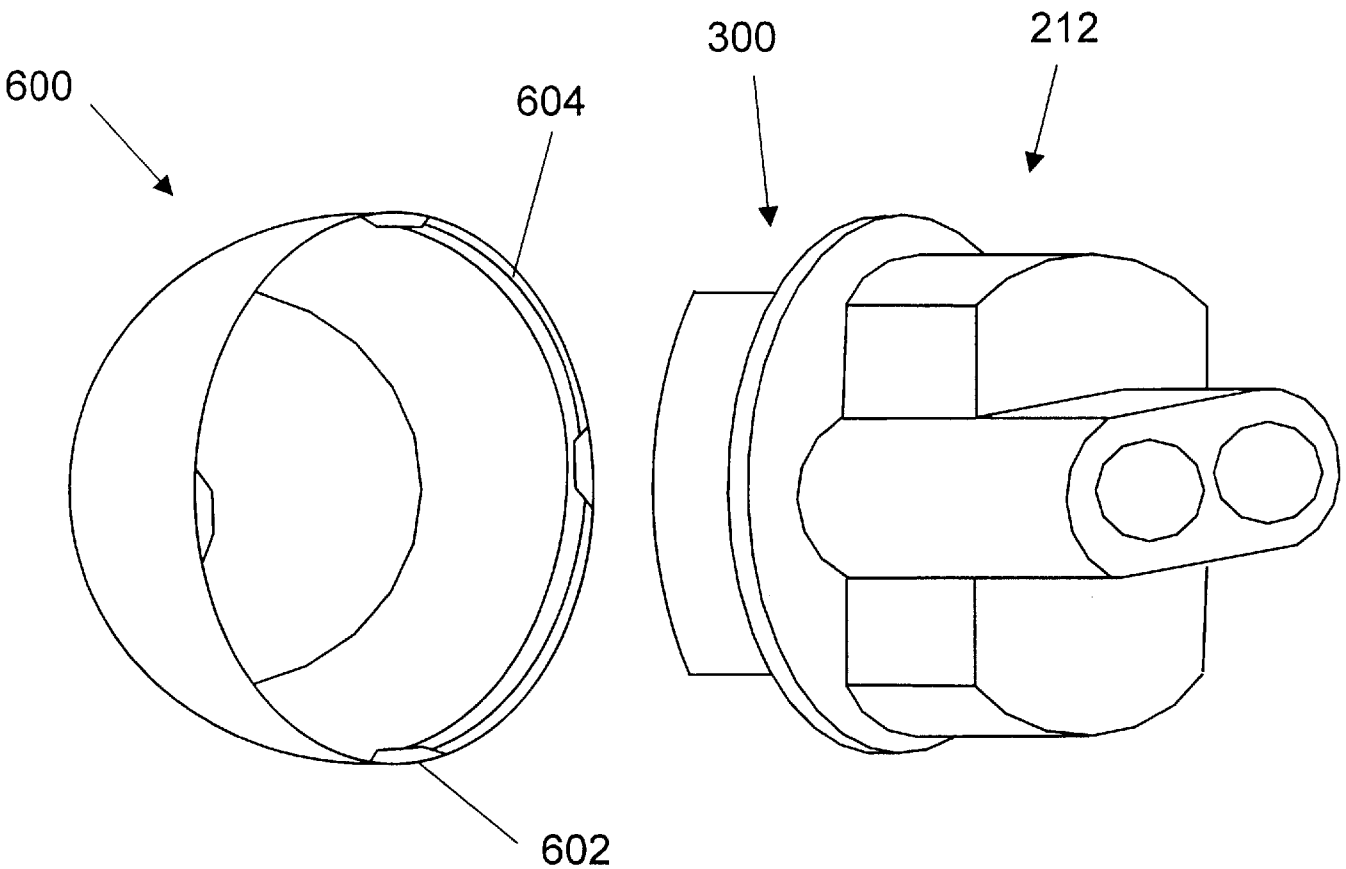
FIG. 6 shows a preferred embodiment of a cover for covering the dual signal feed horn in accordance with the present invention.

In a preferred embodiment of the present invention as shown in FIG. 6, the signal receiving system 200 further comprises a cover 600 for covering the dual signal feed horn 300. The cover 600 has a plurality of clamps 602 coupled to the dual signal feed horn 300 and an O-ring groove 604 for water resistance.

In accordance with the present invention, it provides a compact signal receiver having a dual elliptical corrugated feed horn for increasing C/N ratio and reducing the spill over loss of the energy of signals receiving from two satellites. Further, it provides a sufficient rejection for preventing interference coming from the other satellite.

a cover for covering said dual signal feed horn, said cover having a plurality of clamps coupled to said dual signal feed horn and an O-ring groove for water resistance.

6. An antenna system for receiving electromagnetic signals, the system comprising:

a dual signal feed horn having a pair of frustums and a figure-eight-shaped dual elliptical horn aperture, the cross-section of said frustums linearly devolving from a substantially circular connecting end to a predetermined substantially elliptical end, said figure-eight-shaped dual elliptical horn aperture having a tapered corrugated inner surface, coupled to said predetermined substantially elliptical end of said frustums; and two cylindrical waveguides, each of said cylindrical waveguides being coupled to said substantially circular connecting end of each of said frustums, the radius of said cylindrical waveguides being substantially the same as the radius of said substantially circular connecting end.

7. The signal receiving apparatus of claim 1 further comprising two cylindrical waveguides, each of said cylindrical waveguides being coupled to said substantially circular connecting end of each of said frustums, the radius of said cylindrical waveguides being substantially the same as the radius of said substantially circular connecting end.

8. The antenna system of claim 6, further comprising a cover for covering said dual signal feed horn, said cover having a plurality of clamps coupled to said dual signal feed horn and an O-ring groove for water resistance.

* * * * *